US006920836B2

(12) United States Patent
Sprouse

(10) Patent No.: US 6,920,836 B2
(45) Date of Patent: Jul. 26, 2005

(54) REGENERATIVELY COOLED SYNTHESIS GAS GENERATOR

(75) Inventor: Kenneth M. Sprouse, Northridge, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/677,817

(22) Filed: Oct. 2, 2003

(65) Prior Publication Data

US 2005/0072341 A1 Apr. 7, 2005

(51) Int. Cl.[7] ..... F23M 5/00; F27D 1/12
(52) U.S. Cl. ..... 110/336; 432/233
(58) Field of Search ..... 110/204, 205, 297, 110/303, 305, 308, 314, 336; 60/753, 755, 60/756, 757, 758, 760; 432/233, 238

(56) References Cited

U.S. PATENT DOCUMENTS 3,918,255 A * 11/1975 Holden ..... 60/753
3,954,389 A * 5/1976 Szetela ..... 431/353
4,362,500 A * 12/1982 Eriksson et al. ..... 431/352
6,418,973 B1 7/2002 Cox et al.

OTHER PUBLICATIONS

U.S. Appl. No. 09/954,753, filed Sep. 2001, Marshall et al.
U.S. Appl. No. 10/271,950, filed Oct. 2002, Sprouse et al.

* cited by examiner

*Primary Examiner*—Kenneth Rinehart
(74) *Attorney, Agent, or Firm*—Harness Dickey & Pierce P.L.C.

(57) ABSTRACT

A coolant liner for a carbonaceous fuel (coal or petcoke) gasification vessel including a ceramic composite panel and a method of cooling a vessel. The panel includes at least two layers of woven yarns of fibrous material and walls extending between the layers. Accordingly, the layers and the walls define coolant channels that extend in a warp direction. Moreover, one of the layers may be less than about 0.08 inches thick. Materials used to create the composite panel may include alumina, chromia, silicon carbide, and carbon. Additionally, the liners may be shaped in an arc or have coolant channels which vary in diameter in the warp direction. Additionally, the liner may abut a structural closeout of the vessel. The coolant liner provides a significantly more durable component than previously employed liners and is especially well suited to demanding service environments.

25 Claims, 2 Drawing Sheets

REGENERATIVELY COOLED SYNTHESIS GAS GENERATOR

FIELD OF THE INVENTION

The present invention relates to coolant liners for reaction vessels, and more particularly to ceramic matrix composite coolant liners for regeneratively cooled synthesis gas reactors.

BACKGROUND OF THE INVENTION

Recently, to reduce pollution from fossil fuel power plants much effort has focused on developing both processes and hardware for zero emission power plants. A key component of these efforts includes improving synthesis gas generators, or reactors, which produce hydrogen fuel from low value carbonaceous feedstock such as coal and petcoke. In typical synthesis gas reactors coal, oxygen, and water react to produce the high energy content synthesis gas (hydrogen and carbon monoxide). In the meantime, water flows through a reactor coolant liner to protect the reactor walls from excessive temperatures. In turn, the resulting heated water is fed back into the reactor as the water reactant, thereby regeneratively cooling the reactor.

Prior art coolant liners for synthesis gas reactors are expensive to build and often suffer from low reliability. For instance, some coolant liners use unprotected metal tubes to contain the water coolant as it warms and boils at temperatures below 700 degrees Fahrenheit. Because the gasification occurs near 3000 degrees Fahrenheit, the hot-side metal wall surface temperatures can easily approach 1200 degrees Fahrenheit. These surface temperatures can prove fatal for any long life metal component operating in the alkali slag and sulfur laden product gases in the reactor.

Other prior art reactor coolant liners use thin layers of ceramic coatings (alumina, chromia, or silicon carbide) deposited on the metal tubes to freeze a protective slag layer on top of the thin ceramic coating. However, the protective layer constantly spalls due to thermal shocks and coefficient of thermal expansion mismatches between the protective slag, the ceramic, and the metal tube. Thus, where the protective slag and ceramic coating spalls, the alkali and sulfur compounds attack, and eventually damage, the metal tube. Because of these problems, the prior art reactors suffer from a low mean time between failure, often on the order of mere months.

Other syntheses gas reactors avoid these problems by employing monolithic ceramic brick liners to protect the reactor from damage induced by the high temperatures and corrosive gases. Unfortunately, these monolithic liners require replacement about annually. Since the monolithic liners include high chromia content for resistance to corrosion from the alkali and sulfur laden gases, each replacement can represent a very substantial cost. Moreover, whether a monolithic ceramic or a ceramic coating is employed, these prior art reactors require approximately 12 hours or more to safely warm up and cool down to avoid thermally shocking, and damaging, the ceramics. Accordingly, the requirement for gradual transients hinders the operation of synthesis gas plants, and critically so during emergencies.

Thus a need exists to improve regeneratively cooled synthesis gas reactors.

SUMMARY OF THE INVENTION

In order to make zero emission power plants more efficient, significant improvements of the coal and petcoke gasifiers need to be achieved. For example, the cold gas efficiency of typical gasifiers ranges from 65 to 75%. The low efficiency is partly due to the water slurry coal feed system used to continuously charge the gasifier with coal. For instance changing the feed from a water slurry to a more efficient carbon dioxide based slurry is the subject of Boeing co-owned patent application Ser. No. 10/271,950 which is incorporated by reference as if set forth in its entirety herein. Replacing the water with carbon dioxide requires a separate feed of water, preferably in the form of steam. For optimal efficiency, the steam may be regeneratively produced from the heat removed from the reactor via the reactor coolant liner. Doing so increases the efficiency from approximately 74 to approximately 82 percent at an operating temperature of 2600 F.

Thus, the present invention provides a low cost, high reliability, and rapid start-up regeneratively cooled synthesis gas reactor, a coolant liner, and a method of producing syntheses gas in a regeneratively cooled reactor. Moreover, coolant liners in accordance with the principles of the present invention recover waste heat and produce steam at temperatures ranging from 700 to 800 degrees Fahrenheit by exchanging heat from the alkali and sulfur laden product gas streams. By low cost, herein, it is meant low life cycle costs relative to prior art non-regeneratively cooled synthesis gas reactors. By highly reliable, it is meant that the mean time between failures is greater than three years. By rapid start-up (and shut down), it is meant that gasifier start-up (and shut down) times are on the order of a few seconds.

Moreover, the current invention solves many of the problems associated with the prior art reactors by adapting the ceramic matrix composite structures taught in Boeing co-owned U.S. Pat. No. 6,418,973 which issued to Cox et al. Accordingly, the '973 patent is incorporated by reference as if set forth in full herein. By using these ceramic matrix composite materials, the present invention provides coolant liners and heat exchange surfaces with thin walls. Accordingly, the hot-side surfaces of the coolant liners will not exceed 2000 degrees Fahrenheit even when employed in a synthesis gas reactor. Additionally, by avoiding the use of metal substrates in the reactor's coolant liner, all alkali and sulfur corrosion associated with the formation of low temperature metal eutectics are eliminated from the coolant liner. Furthermore, high shear stresses at the metal to ceramic interfaces (because of thermal expansion coefficient mismatches) and the associated spalling are likewise eliminated.

In a preferred embodiment, the present invention provides a coolant liner including a ceramic composite panel for a vessel. The panel includes at least two layers of woven yarns of fibrous material and walls extending between the layers. Accordingly, the layers and the walls define coolant channels that extend in a warp direction. Moreover, one of the layers may be less than about 0.08 inches (2.032 millimeters) thick. Materials used to create the composite panel may include alumina, chromia, silicon carbide, and carbon. Additionally, the liners may be arc shaped or have coolant channels which vary in diameter in the warp direction. Additionally, the liner may abut a structural closeout of the vessel.

Another preferred embodiment provides a cooled vessel. The cooled vessel includes a ceramic composite coolant liner with at least two layers of woven yarns of fibrous material and walls extending between the layers. The layers and the walls define coolant channels that extend in a warp direction. A structure abuts the coolant liner so that the structure retains the pressure in the vessel. Moreover, the vessel may be a regeneratively cooled synthesis gas reactor or gasifier.

Another preferred embodiment provides a method of cooling a vessel. The method includes retaining pressure in the vessel with a structure, and abutting the structure with a ceramic composite coolant liner. The coolant liner includes at least two layers of woven yarns of fibrous material and walls extending between the layers, the layers and the walls thus define coolant channels that extend in a warp direction. Additionally, the method includes flowing a coolant through the coolant channels. Moreover, the method may include reacting the coolant with the contents of the vessel after the coolant has flowed through the coolant channels thereby creating synthesis gas in the vessel.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
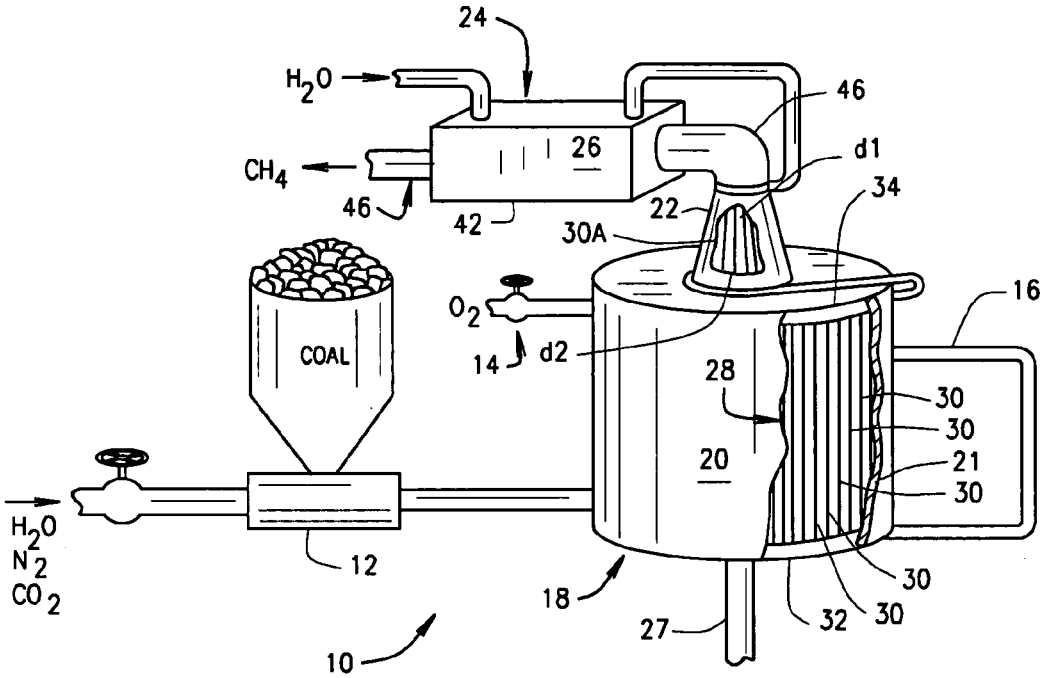
FIG. 1 is a perspective view of a synthesis gas reactor in accordance with a preferred embodiment of the present invention.

As shown in FIG. 1, a synthesis gas system 10 in accordance within the principles of the present invention includes a source of coal 12, a source of air (or oxygen) 14, a source of water (superheated or saturated steam typically at about 700 degrees Fahrenheit) 16, a reactor 18 including a wall (or pressure vessel shell) 20, an exit nozzle 22, and a waste heat recovery section 24. While the reactor 18 shown is a coal gasifier, the gasifier will be referred to as a reactor to illustrate that the present invention is not limited to coal gasifiers. Pulverized coal may be carried into the reactor by a water, a nitrogen, or a carbon dioxide based slurry.

Within the reactor, the oxygen and a portion of the coal react to provide the heat necessary for the synthesis gas reaction in which the remainder of the coal is converted to primarily carbon monoxide (CO) and hydrogen (H2) by reactions with steam (H2O) and carbon dioxide (CO2). From the reactor 18 the hot (approximately 2700 degrees Fahrenheit or about 1480 degrees Celsius) hydrogen laden product and waste gases (hydrogen and carbon monoxide) flow to the waste heat recovery section 24 where a heat exchanger 26 cools the mixture thereby recovering heat from the process. Molten slag flows from the bottom of the reactor 18 via a drain 27 thereby removing most of the mineral ash from the reactor 18 in a liquid phase.

Where the reactor 18 is regeneratively cooled, the reactor wall 20 includes a coolant liner 28 (shown in partial cut away view) attached to the inside of a structural metal jacket, or close out 21. The coolant liner 28 includes a large number of channels 30 through which the coolant water flows. As the water flows through the channels 30, it absorbs heat from the products of the reaction through the channel walls. Upon leaving the channels 30, the water may be saturated steam. From the coolant liner 28 the steam flows into the reactor 18 as one of the reactants. In this manner, heat which must be removed to protect the wall 20 of the reactor is returned to the reaction thereby increasing the energy efficiency of the process. Headers and manifolds 32 and 34 direct the water into the channels 30 and collect the steam from the channels 30 as shown.

Just outside of the coolant liner 28 the standard structural metal jacket, or close out 21, is shown. The close out 21 is similar in construction to those found in rocket engine designs from the 1950s thru 1970s developed by the Boeing Corporation of Chicago, Ill. The close out 21 and the coolant liner 28 are bonded together in a conventional manner so that the reactants and products do not flow between the coolant liner 28 and the close out 21. Accordingly, the close out 21 retains the gases and pressure in the reactor 18, prevents leaks, and provides structural support to the coolant liner 28.

Figure 2:
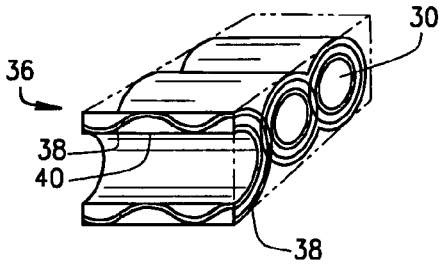
FIG. 2 is a perspective view of a coolant panel in accordance with a preferred embodiment of the present invention.

With reference now to FIG. 2, a ceramic matrix composite coolant liner panel 36 in accordance with the present invention is shown. The panels may be formed in arc segments which when placed side-by-side will close out a cylindrical vessel. The coolant channels 30 within each panel 36 may have variable inside diameters so that various reactor vessel wall 20 contours, in addition to cylindrical, can be achieved. For example, the panels 36 may be used to form an exit nozzle 22 (see FIG. 1) for the reactor 18 just upstream of the waste heat recovery section of the system. In the exit nozzle 22 a series of channels 30A is shown. The channels 30A (also shown in partial cut away view) increase in diameter from a diameter d1 to a diameter d2 in a generally linear fashion. Thus, the exit nozzle 22 assumes a generally conic shape having an increasing coolant flow area in the direction opposite that of the hot product gases. Accordingly, the nozzle may be employed as a counter flow heat exchanger which accommodates the expansion of the steam as it absorbs heat from the product gases.

The coolant liner 28 is ideally suited for coal gasification by the fact that its wall thicknesses are relatively thin (below about 0.08 in.) so that the hot side wall temperatures remains below the slag/ceramic reaction temperature threshold of about 2000 degrees Fahrenheit (about 1093 degrees Celsius). Fibers 38 of the coolant liner may be made from alumina (Al2O3), chromia (Cr2O3), silicon carbide (SiC), or carbon. Though, for service in the alkali and sulfurous environment in the reactor, alumina and chromia fibers 38 are preferred. A matrix 40 of the coolant liner 36 may be made of alumina, chromia, or silicon-carbide (SiC). Though, for resistance to chemical attack from the alkali metal silicates (slag), the matrix 40 of either silicon carbide or a mixture of alumina and chromia is preferred. However, if lower thermal conductivity walls are desired and can be tolerated for other applications, the matrix material may be alumina/chromia mixtures.

Thus, the coefficient of thermal expansion of the ceramic matrix composite is relatively close to that of solidified slag so that any slag striking and freezing on the hot surface of the coolant liner 28 will adhere to the surface and not subsequently spall. Preferably the materials of the fibers 38 and matrix 40 (FIG. 2) are selected such that the coefficient of thermal expansion of the composite is between about $1\times10^{-6}$ and about $3\times10^{-6}$ inch/inch-degree F. It should be noted that whereas conventional metal cooling tubes have a coefficient of thermal expansion on the order of $6\times10^{-6}$ to $10\times10^{-6}$ inch/inch-degree F., the slag has a coefficient which approximates that of the ceramic matrix composites of the present invention or slightly less. Accordingly, the slag silicates (which typically have coefficients of thermal expansion in the range of $0.5\times10^{-6}$ to $3\times10^{-5}$ inch/inch-F) will form a durable protective barrier against detrimental erosion (spalling) of the coolant liner 28.

Additionally, the fibers 38 may include a graphite de-bond layer (not shown). Including a de-bond layer prevents cracks, should they initiate in the matrix 40, from damaging the fibers 38. Instead, if the crack propagates to the de-bond layer, the energy of the crack causes the de-bond layer to de-bond from the fiber thereby preserving the fiber 38. The de-bond layer may be deposited by chemical vapor deposition or any conventional means to form a coating on the fibers 38.

It should be noted that the coolant liner fibers 38 have been shown to withstand severe thermal shocks thereby enabling the coolant liner to be heated from ambient conditions to over 2,000 degrees Fahrenheit (about 1093 degrees Celsius) within 2 seconds without detrimental cracking and associated coolant leakage. Moreover coolant liners 28 with graphite fibers 38 and silicon carbide matrices 40 have performed well in high temperature combustion of hydrogen and oxygen. Since silica and alumina fibers are commercially available and possess similar mechanical properties coolant liners 28 with either silica or alumina fibers may be constructed with walls thin enough to keep the hot side wall temperature below the 2000 degree Fahrenheit threshold. Accordingly, coolant liners 28 in accordance with the present invention are superior for lining and protecting synthesis gas reactors 18. Further details regarding the ceramic matrix composite are described in U.S. Pat. No. 6,418,973 patent which is incorporated herein by reference in full.

In another preferred embodiment, carbon may be used for either the fibers or the matrix of the composite, particularly for use in petcoke gasifiers. Since petcoke contains little mineral content, the gasification of petcoke produces little if any alkali slag or sulfur compounds. Accordingly, coolant liners and heat exchangers composed in part, or entirely, of carbon may be used in petcoke synthesis gas reactors because corrosion of the composite material is of correspondingly less concern.

Figure 6:
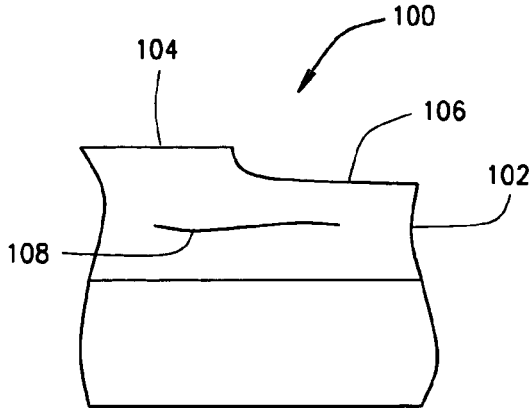
FIG. 6 PRIOR ART
FIG. 6 is an illustration of a section of a prior art monolithic liner for a gasification vessel having a crack due to unequal coefficient of thermal expansion.

In contrast to coolant liners in accordance with the principals of the present invention, FIG. 6 shows a cross section of a typical, prior art, monolithic liner 100 which has been exposed to the corrosive environment in the reactor. FIG. 6 shows that the prior art liner 100 has a reaction layer 102 near a hot surface 104 which was exposed to the corrosive reaction environment. Throughout the reaction layer 102 the corrosive slag has diffused into the prior art liner 100. Typically, the reaction layer 102, created by the slag diffusion, may be about 5 cm deep which is a significant fraction of the total depth of the prior art liner 100. Thus, a significant portion of the prior art layer is undergoing corrosive attack, by the slag.

Additionally, thermal cycling of the reactor also damages the prior art liner 100. For instance, on the hot surface 104 a deformity 106 can be seen where liquid slag diffused into the surface 104 and chemically reacted with the ceramic thereby causing or producing a crack which spalled off during a temperature change. The spalling left the liner with the deformity 106. Also shown is a severe circumferential crack 108 which also developed as a result of the ongoing chemical attack by the slag. In particular rapid shutdowns (e.g. emergency reactor trips) and startups cause cracks similar to crack 108 to propagate through the ceramic. Because of the crack 108, the liner 100 remains susceptible to the formation of additional deformities 106.

These mechanical weaknesses of the prior art liner 100 are aggravated by the corrosive attack ongoing throughout the reaction layer 102. The chemical attack chemically alters the parent, ceramic material converting it into a product of the slag and the ceramic material chosen for the liner. Thus, the coefficient of thermal expansion of the resulting corrosion product no longer matches the coefficient of the parent ceramic. Accordingly, the chemical attack creates yet another region within the ceramic where a disadvantageous coefficient mismatch occurs, thereby leading to cracks 108.

The present invention, though, provides thin walled coolant liners which are not susceptible to slag penetration since the liner is design to always operate well below the slag liquidus temperature where diffusion is promoted. Nor do the thin walled coolant liners of the present invention crack or spall. Accordingly, the present invention provides coolant liners with longer service lives than the prior art liners. Moreover, because of the thin walled liner provided by the present invention reactors in accordance with a preferred embodiment of the present invention may shut down and start up rapidly (in less than 5 seconds) without damaging the liner.

Figure 3:
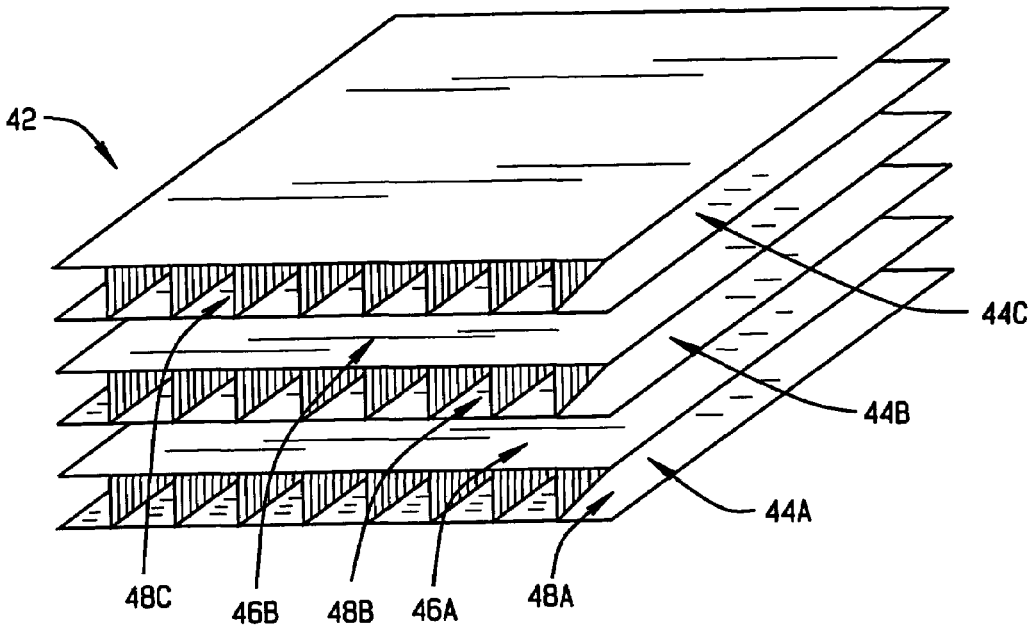
FIG. 3 is a perspective view of a heat exchange in accordance with a preferred embodiment of the present invention.

Turning now to FIG. 3, a preferred embodiment of the present invention provides a synthesis gas reactor waste heat recovery heat exchanger. The heat exchanger 42 includes multiple flat panels 44 and is placed in the product line 46 leading from the reactor 18 (See FIG. 1). Because of the high temperature and high flow rate of the product gases, the heat exchanger may also generate the bulk of the saturated steam for use in the reactor as a reactant. Here the panels are oriented to form a parallel flat plate heat exchanger with product gas flowing in the spaces 46A and 46B between adjacent panels 44 and water flowing in the channels 48A, 48B, and 48C preferably. To simplify the manifolds and closeouts (not shown) associated with the heat exchanger 42 the product gases may flow from left to right (or vice versa) through the spaces 46A and 46B with water flowing into or out of the page along the channels. This arrangement assures minimal pressure loss through the heat exchanger 42 on the product gas side. Note that close outs (the heat exchanger pressure vessel shell) and product gas and water manifolds have not been shown for clarity.

Figure 4:
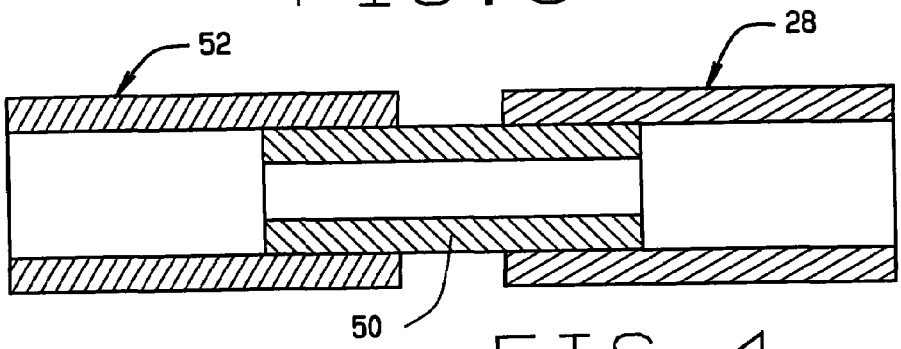
FIG. 4 is a cross sectional view of a connector in accordance with a preferred embodiment of the present invention.

With reference to FIG. 4, silicon nitride fittings 50 may be used to join the ceramic matrix composite coolant liner 28 and heat exchanger 42 to a metal header or manifold 52 as taught in Boeing co-owned U.S. patent application Ser. No.

09/954,753 which is incorporated herein by reference as if set forth in full. These ceramic/metal joints have been tested to over 2,000 psia. Moreover, heat exchange surfaces in accordance with the present invention have been shown to conduct heat fluxes of greater than 20 BTU/inch-inch-second.

Figure 5:
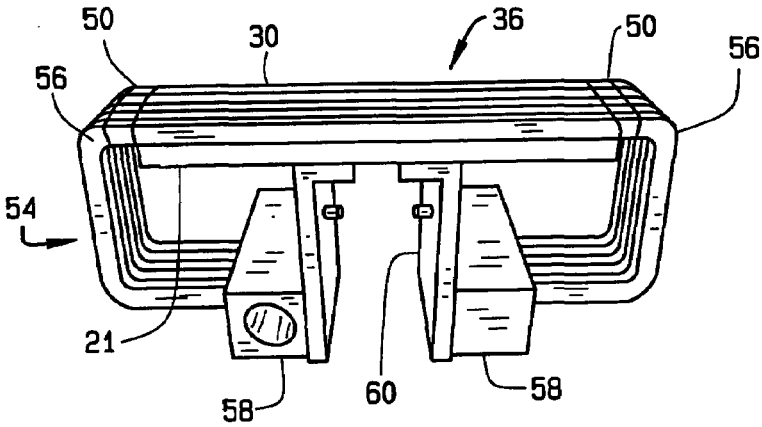
FIG. 5 is a perspective view of a coolant panel assembly in accordance with a preferred embodiment of the present invention.

Now turning to FIG. 5, a coolant panel assembly 54 in accordance with a preferred embodiment of the present invention is shown. The assembly includes a coolant panel 36 with coolant channels 30, metal tubes 56, fittings 50, a pair of manifolds 58, structure 60, and a close out 21. As shown, the fittings 50 and manifolds 58 may be advantageously positioned behind the closeout 21 or other cooled structure to protect these metallic components from the high temperature, corrosive environment within the reactor. As noted herein, the coolant panel 36 may be arc shaped so that joining a series of coolant panel assemblies 54 (along with pressure vessel top end pieces) creates a cylindrical vessel. Joining the panels may be by way of welding the close outs 21 of adjacent assemblies 54 to each other with reinforcing rings, or hatbands (not shown), surrounding the joined assemblies 54. Additionally, while the channels 30 have been shown as possessing a circular cross section, the present invention is not limited to channels 30 with circular cross sections. In particular, channels 30 possessing square and rectangular cross sections are within the spirit and scope of the present invention.

Thus, improved coolant liners and heat exchangers for demanding service environments have been described. Moreover, a low cost, synthesis gas reactor having a cold gas efficiency above 82 percent and fast start capabilities has been described. Additionally, because the present invention allows a durable protective layer of slag to form and remain on the heat exchange surfaces of the coolant liners and heat exchangers, the slag will neither penetrate nor react with the ceramic. Also, because of the excellent bond between the protective barrier and the ceramic matrix composite wall, the cracking and spalling associated with the prior art is avoided, thereby providing coolant liners and heat exchangers with increased service lives. The present invention provides these benefits even for service environments with coolant pressures exceeding 2000 psi and hot side wall temperatures just below slag fusion temperatures of approximately 2000 degrees Fahrenheit.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A coolant liner for a carbonaceous fuel gasification vessel, comprising:

a ceramic composite panel including at least two layers of woven yarns of fibrous material, the ceramic composite panel having a coefficient of thermal expansion approximately equal to a coefficient of thermal expansion of solidified slag produced within the gasification vessel; and wherein the layers of fibrous material include walls extending between the layers, the layers and the walls defining coolant channels that extend in a warp direction.

2. The coolant liner according to claim 1, wherein one of the at least two layers comprises a thickness of less than about 0.08 inches.

3. The coolant liner according to claim 1, wherein the vessel further comprises a regeneratively cooled reactor.

4. The coolant liner according to claim 3, wherein the fibrous material further comprises one of silica and chromia.

5. The coolant liner according to claim 1, wherein the panel further comprises alumina.

6. The coolant liner according to claim 1, wherein the panel is configured to withstand a change in temperature from an ambient temperature to approximately 2000° F. (1093° C.) in less than approximately 5 seconds without cracking.

7. The coolant liner according to claim 1, wherein the panel further comprises one of silicon carbide and carbon.

8. The coolant liner according to claim 1, further comprising a layer of the solidified slag formed by liquefied slag produced within the gasification vessel striking and adhering to the ceramic composite panel.

9. The coolant liner according to claim 1, wherein the ceramic composite panel coefficient of thermal expansion equals between approximately $1\times10^{-6}$ inch/inch-degree F. and approximately $3\times10^{-6}$ inch/inch-degree F.

10. The coolant liner according to claim 1, wherein a diameter of the channels varies in the warp direction.

11. The coolant liner according to claim 1, wherein the panel abuts a metal closeout.

12. A carbonaceous fuel gasification vessel, comprising:

a ceramic composite coolant liner including at least two layers of woven yarns of fibrous material and walls extending between the layers, the layers and the walls defining coolant channels that extend in a warp direction;

a layer of solidified slag formed by liquefied slag produced within the gasification vessel striking and adhering to the ceramic composite coolant liner, wherein the ceramic composite coolant liner has a coefficient of thermal expansion approximately equal to a coefficient of thermal expansion of solidified slag so that the layer of solidified slag provides a protective barrier against spalling of the ceramic composite coolant liner; and a pressure retaining structure abutting the coolant liner for retaining a pressure developed in the vessel.

13. The vessel according to claim 12, wherein one of the at least two layers has a thickness of less than about 0.08 inches.

14. The vessel according to claim 12, further comprising a regeneratively cooled reactor.

15. The vessel according to claim 14, wherein the fibrous material further comprises one of silica and silicon carbide.

16. The vessel according to claim 12, wherein the coolant liner further comprises alumina.

17. The vessel according to claim 12, wherein the coolant liner further comprises one of chromia and carbon.

18. The vessel according to claim 12, wherein the coolant liner is configured to withstand a change in temperature from an ambient temperature to approximately 2000° F. (1093° C.) in less than approximately 5 seconds without cracking.

19. The vessel according to claim 12, wherein the coolant liner is configured to withstand a change in temperature from an ambient temperature to approximately 2000° F. (1093° C.) in approximately 2 seconds without cracking.

20. The vessel according to claim 12, wherein the ceramic composite coolant liner coefficient of thermal expansion equals between approximately $1\times10^{-6}$ inch/inch-degree F. and approximately $3\times10^{-6}$ inch/inch-degree F.

21. The vessel according to claim 12, wherein a diameter of the coolant channels varies in the warp direction.

22. A method of cooling a carbonaceous fuel gasification vessel, comprising:

retaining a pressure in the vessel with a pressure retaining structure;

abutting the pressure retaining structure with a ceramic composite coolant liner which includes at least two layers of woven yarns of fibrous material and walls extending between the layers, the layers and the walls defining coolant channels that extend in a warp direction;

forming a layer of solidified slag on the ceramic composite coolant liner, wherein the ceramic composite coolant liner has a coefficient of thermal expansion approximately equal to a between approximately $1\times10^{-6}$ inch/inch-degree F. and approximately $3\times10^{-6}$ inch/inch-degree F. so that the layer of solidified slag provides a protective barrier against erosion of the ceramic composite coolant liner; and flowing a coolant through the coolant channels.

23. The method according to claim 22, further comprising limiting the thickness of one of the at least two layers to less than about 0.08 inches thick.

24. The method according to claim 22, further comprising reacting the coolant with the contents of the vessel after the coolant has flowed through the coolant channels.

25. The method according to claim 22, wherein the ceramic composite coolant liner is configured to withstand a change in temperature from an ambient temperature to approximately 2000° F. (1093° C.) in less than approximately 5 seconds without cracking.

* * * * *